United States Patent [19]

Klee

[11] Patent Number: 4,475,351

[45] Date of Patent: Oct. 9, 1984

[54] DUAL-FLOW CRYOGENIC FREEZER

[75] Inventor: David J. Klee, Emmaus, Pa.

[73] Assignee: Air Products and Chemicals, Inc., Allentown, Pa.

[21] Appl. No.: 521,788

[22] Filed: Aug. 9, 1983

[51] Int. Cl.[3] ..... F25D 13/06

[52] U.S. Cl. ..... 62/63; 62/216; 62/374; 62/380; 62/404

[58] Field of Search ..... 62/63, 374, 375, 380, 62/404, 216

[56] References Cited

U.S. PATENT DOCUMENTS

| | | | |
|---|---|---|---|
| Re. 28,712 | 2/1976 | Klee | 62/216 |
| 3,345,828 | 10/1967 | Klee et al. | 62/63 |
| 3,403,527 | 10/1968 | Berreth et al. | 62/266 |
| 3,613,386 | 10/1971 | Klee | 62/64 |
| 3,813,895 | 6/1974 | Klee et al. | 62/266 |
| 3,892,104 | 7/1975 | Klee et al. | 62/186 |
| 4,229,947 | 10/1980 | Klee | 62/374 |

*Primary Examiner*—Ronald C. Capossela

*Attorney, Agent, or Firm*—Geoffrey L. Chase; E. Eugene Innis; James C. Simmons

[57] ABSTRACT

Products to be frozen are conveyed through an insulated horizontal tunnel having a plurality of individual cooling zones, each equipped with a radial fan rotating in a horizontal plane. Cryogenic liquid refrigerant is sprayed into one or more of the cooling zones in the central region of the tunnel, upwardly into the rotating fans and the thus vaporized refrigerant caused to flow in a downward direction in a recirculating pattern into contact with the conveyed products by vertical partitions between contiguous zones. The vaporized refrigerant flows from the supercold zone of liquid introduction beneath the edges of the partitions in two directions, outwardly towards the opposite ends of the tunnel in substantially equal amounts. The treated products thus undergo a continuously declining temperature gradient from inlet to outlet of the tunnel as a result of direct heat exchange with refrigerant vapor in counterflow thereto from the supercold zone to the products inlet and concurrent flow of the vapor from said supercold zone to the products outlet.

21 Claims, 6 Drawing Figures

DUAL-FLOW CRYOGENIC FREEZER

BACKGROUND OF THE INVENTION

The present invention relates generally to refrigeration and is particularly concerned with systems wherein products to be frozen, such as foods, are moved continuously through a treating tunnel while being contacted with cryogenic coolant.

Apparatus for continuous cooling and freezing of products, particularly food and the like, are well known in the art as exemplified, for example, by U.S. Pat. No. Re. 28,712; U.S. Pat. Nos. 3,403,527; 3,613,386; 3,813,895; 3,892,104; 4,229,947; which are assigned to the assignee of the present invention. Such apparatus usually includes an elongated tunnel defined by insulated walls and an endless conveyor belt extending longitudinally of the tunnel for moving articles therethrough. A cryogenic fluid, such as liquid nitrogen (LIN) is introduced as a spray into the tunnel, usually near the products exit end thereof. In a typical operation the liquid coolant is sprayed directly onto the product on the conveyor and is thereby vaporized by heat exchange therewith and is induced to flow through the tunnel as a vapor in counterflow relation to the movement of products on the conveyor, and is discharged near the products inlet end of the tunnel.

Systems of the type described, when properly operated under precise control, are highly efficient in utilization of coolant but are relatively costly. A sophisticated gas flow control system is required to pump the cold nitrogen gas toward the tunnel entrance. The volume of cold gas moved must exactly match the volume that is generated by vaporization of the coolant in the spray zone. If the pumped volume is too low, the excess very cold nitrogen gas spills out of the products discharge end of the tunnel, wasting about half of the available refrigeration. If the pumped volume is too high, warm room air will be pulled into the products discharge end of the tunnel, causing a large heat loss and frost accumulation. The gas flow control system requires a steady flow of coolant to function properly. Accordingly, the coolant control system must be provided with a proportioning controller and a motorized coolant supply valve to modulate flow of the coolant. This type of control system, manifestly, is more expensive, more complicated and more difficult to maintain than a simple "on-off" flow-control system.

Another disadvantage found in freezers of the type described, is their sensitivity to two-phase flow. As liquid nitrogen flows through a transfer line from the supply source, the pressure is lowered and heat enters through the insulation. These factors cause a portion of the coolant to vaporize, thereby forming a two-phase mixture of liquid and gas. In some cases, the liquid and gas segregate into slugs of gas followed by slugs of liquid. Such slug flow is very detrimental to the operation of the freezer. When the slug of coolant gas enters the spray header, the direct contact spray of liquid coolant is lost. Since direct spray of liquid coolant on the products provides about one-half of the refrigeration in these systems, the product passing under a gas-filled spray header will not be cooled sufficiently. Thus, when slug flow conditions occur, the product will be cooled erratically and incompletely.

The foregoing problems are not encountered in other systems wherein the product to be frozen is immersed in the cryogenic liquid coolant. Such systems comprise an insulated tank filled with LIN or other cryogenic liquid coolant, and a conveyor belt arranged to dip the conveyed product into the liquid. Such immersion freezer utilizes the latent heat of the liquid coolant but discards the very cold gas formed by the contact vaporization. The exhaust gas temperature of a typical LIN immersion freezer has been measured to be about −280° F. (−173° C.). Although such immersion freezers are of simple construction, easy to operate and occupy relatively little floor space, they are very inefficient with respect to utilization of coolant.

The coolant efficiency of any alternate freezing system can be compared with the heretofore described system of the direct spray type to establish their relative freezing costs. Assuming that liquid nitrogen (LIN) is employed as the coolant:

$E_{LIN}=(Q_A/Q_L)\ 100$ wherein $E_{LIN}$=LIN effeciency, %

$Q_A$=available refrigeration of LIN warmed to the nitrogen gas discharge temperature, Btu/lb. LIN $Q_L$=availabe refrigeration of LIN warmed to the incoming product temperature, Btu/lb. LIN For a LIN storage tank pressure of 17.5 psig $Q=81.0+0.252\ (320+T)$, Btu/lb. LIN;

where T=Nitrogen gas temperature, °F. (81.0 is the latent heat of liquid nitrogen at the storage pressure and 0.252 is its specific heat).

For an immersion type LIN freezer:

$$E_{LIN}=\frac{81.0+0.252\ (320-280)}{81.0+0.252\ (320+100)}\times 100=48.7\%$$

For a freezing system of the type hereinbefore described utilizing direct spray of LIN on the product conveyed through the freezing tunnel and counterflow of vaporized LIN toward the product entrance end; wherein the products are brought from an inlet temperature of +100° F. to a discharge temperature of 30° F. with a nitrogen gas discharge temperature of +20° F., the LIN efficiency is:

$$E_{LIN}=\frac{81.0+0.252\ (320+20)}{81.0+0.252\ (320+100)}\times 100=89.2\%$$

The highest LIN efficiency is achieved in systems employing counterflow heat exchange between coolant and product cooled. However, this high LIN efficiency can be had and maintained only by carefully controlled operating practices and adequate maintenance of the equipment.

Among the objects of the present invention are to provide a simple, continuous cryogenic freezer of relatively low cost that can freeze products, such as foods or the like, economically and with relatively little sacrifice in LIN efficiency.

SUMMARY OF THE INVENTION

The foregoing objective is achieved, in accordance with the invention, by the provision of a cryogenic fluid freezer system which utilizes an intermediate supercold product cooling region of gas-solid contact instead of a direct contact of the product with the liquid coolant, and wherein the coolant gas is split to flow from said supercold region in two directions, (1) one portion flowing toward the products inlet end of the freezer in counterflow relation to the products being treated and (2) the other portion flowing in opposite direction, concurrent to the conveyed products, towards the products discharge end. In preferred operation, the quantity of coolant gas flowing in each direction is substantially the same.

The operation of the system in accordance with the invention will be understood and its several advantages appreciated from the detailed description which follows read in connection with the accompanying drawings, illustrating a preferred embodiment.

DETAILED DESCRIPTION

Figure 3:
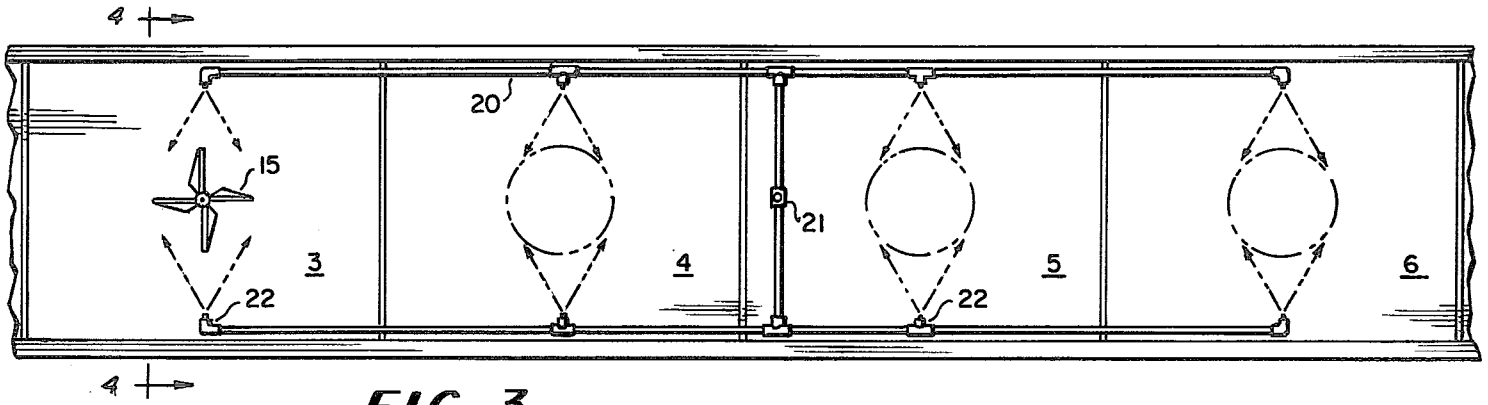
FIG. 3 is an enlarged partial plan view of a central portion of the freezer system shown in FIG. 1, with portions omitted for clarity.
Figure 4:
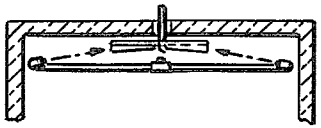
FIG. 4 is a sectional view taken along line 4—4 of FIG. 3.

The freezer 10 comprises a typical insulated tunnel of the general type shown and described in the previously cited U.S. patents. An endless mesh belt 11 passes longitudinally through the tunnel from a products loading station 12 to a products discharge station 14, driven by any suitable means. As shown, the tunnel is provided with eight contiguous gas recirculation zones, numbered 1 to 8, although a larger or smaller number of such treating zones may be utilized. Each zone is provided with a gas recirculating fan 15 suspended from the roof of the tunnel. Each of the fans, which are of the radial flow type, is separately driven by a motor 16. The cryogenic coolant, such as liquid nitrogen, is injected in one or more zones near the longitudinal central region of the freezer tunnel. In the embodiment illustrated, the liquid coolant may be injected into four such zones 3, 4, 5 and 6 by means of a manifold 20 from a supply line 21 connected to a liquid coolant storage tank (not shown). Manifold 20 is connected within each of said zones 3 to 6 to a plurality of nozzles 22 oriented to spray the liquid coolant upwardly into the associated fan, e.g. fan 15 as shown in FIGS. 3 and 4. The liquid coolant is thus vaporized by expansion into the treating zone, providing recirculating cold gas for contact with the product on the belt passing through the respective zones.

Figure 1:
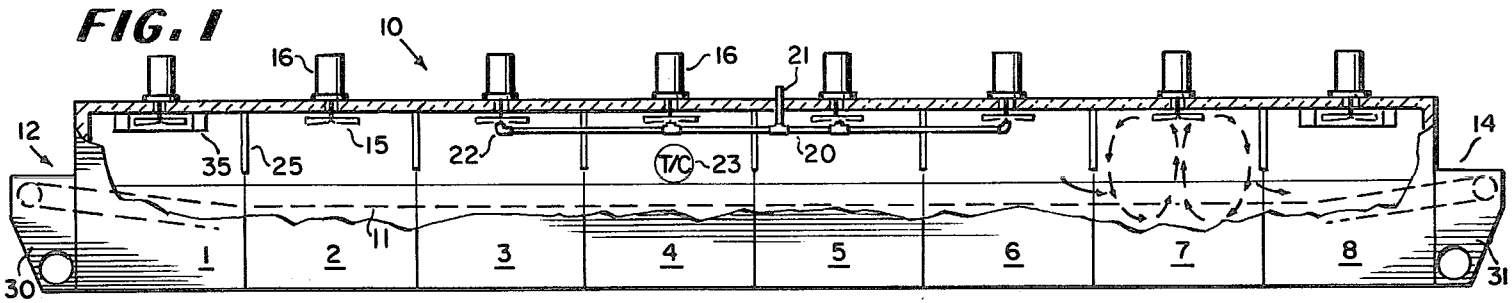
FIG. 1 is a simplified schematic representation in elevation of a freezer system for practice of the invention.

As shown in FIG. 1, each of the cooling zones 1 to 8 is provided with an individual recirculating fan 15. The fans in the consecutive zones are arranged to rotate in a horizontal plane in opposite directions. Thus, while the fans in zones 1, 3, 5 and 7 rotate counterclockwise, the fans in zones 2, 4, 6 and 8 rotate clockwise. All of the fans in zones 2 to 7 are otherwise substantially alike except for the fan system in the initial and final cooling zones (zones 1 and 8 in the illustrated embodiment) which have certain differences from the others as will hereinafter be explained.

Referring now more particularly to FIGS. 3 and 4, the arrangement of the coolant spray nozzles is explained. In the illustrated embodiment, the liquid coolant is sprayed into the central region of the tunnel comprising zones 3 to 6. The spray nozzles 22 are arranged at the side edges along the length of these coolant recirculating zones, the spray stream being directed inwardly and upwardly toward the center of the fan in a V-pattern. The liquid coolant spray is evaporated on discharge into the cooling zone and the cold vapors are hurled radially outward by the fan blades. Partitions 25 which extend downwardly from the roof of the tunnel to an article clearance level above conveyor belt 11 restrict the direct flow of the vaporized coolant between zones. As the outward radial flow of the coolant stream leaving the rotating fan is obstructed by the partitions 25, the flow of coolant vapor is directed downwardly toward belt 11, a portion passing through the reticulated belt, and is then impelled upwardly toward the axis of rotation of the fan blade because of the existing pressure differential. The pattern of flow of the recirculating coolant vapor stream is illustrated by the arrows in zone 7 of FIG. 1. The same general flow pattern of coolant vapors prevails in the zones in which liquid coolant is not introduced as in the other zones in which the liquid coolant is sprayed. Thus the coolant in each zone is largely confined to recirculation within that zone in a pattern resembling an elongated toroid. Due to the component of rotation imposed by the fan blades, spiral flow patterns are created and the elongated toroidal pattern rotates about the rotational axis of the fan.

As seen in FIG. 1, the system is provided with a vapor collection chamber 30 outside the insulated tunnel adjacent to the product inlet end of the tunnel (below the loading station 12) and a similar vapor collection chamber 31 at the products outlet end (below unloading station 14) into which chambers the spent coolant is discharged respectively from zones 1 and 8. The collected vapors from chambers 30 and 31 are discharged by suitable arrangements of ducts and exhaust fans in a known manner.

Because of the vapor discharge at each end of the freezing tunnel, there is a declining pressure gradient inducing a positive flow of coolant vapor from the central region of the tunnel, into which coolant is initially introduced, outwardly in opposite directions towards the respective collection chambers 30 and 31. Thus, in the illustrated embodiment, the coolant vapor flows sequentially from zone 4 to zone 1 under the terminal edges of each of the partitions 25 in a direction counter to the direction of movement of the articles on belt 11, and likewise from zone 5 to 8 concurrent to the direction of movement of the articles on the belt.

Figure 5:
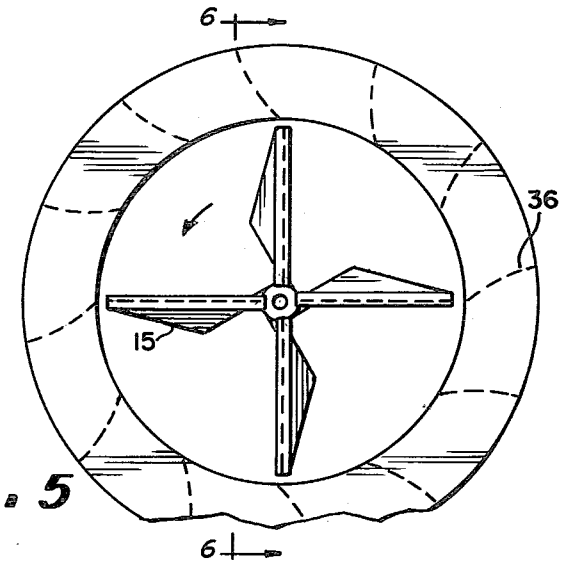
FIG. 5 is an enlarged plan view of a fan structure in zones 1 and 8 of FIG. 1.
Figure 6:
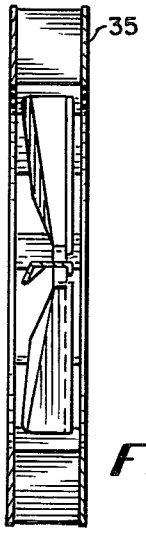
FIG. 6 is a sectional view taken along lines 6—6 of FIG. 5.

As seen in FIGS. 1, 5 and 6, the fan system in zones 1 and 8 is somewhat modified as compared to the fans in the intermediate recirculating zones 2 to 7. Rotation of the fans at the recirculating zones adjacent to the products inlet and outlet ends of the tunnel would present a low pressure region adjacent to the inner edges of the fan blades, thus tending to suck outside warm air into the recirculating vapors in these zones, consequently lowering the cooling efficiency of the system. To prevent such influx of outside air at each of the ends of the freezing tunnel, the fans in zones 1 and 8 are each surrounded by a circumferential stator ring 35, having stationary blades 36 curved in a direction opposing the direction of rotation of the annulus of coolant vapors under the influence of the blades of fan 15. Thus, in zone 1 wherein fan 15 is rotating the coolant vapors in counter-clockwise direction, blades 36 of the stator are curved so that the concave surface of each blade faces clockwise. In zone 8, on the other hand, wherein fan 15 is rotated clockwise, the concave surface of blades 36 faces counter-clockwise.

Figure 2:
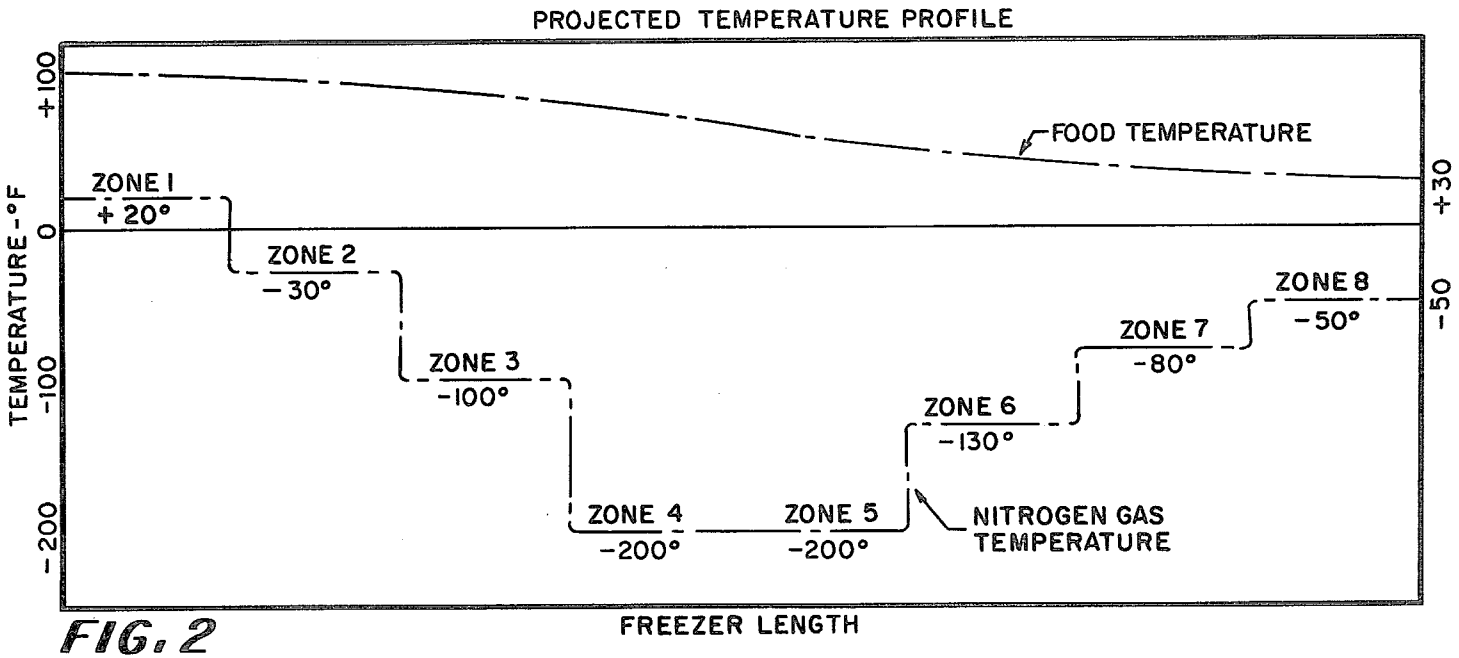
FIG. 2 is a projected temperature profile showing the product temperature pattern from the product inlet end to the outlet thereof and the average gas temperature in the contiguous treating zones along the path between the inlet and outlet ends of the freezer.

The temperature profile curves shown in FIG. 2 are based on a projected operation wherein baked goods, for example, are to be frozen. The warm porduct enters the tunnel at +100° F. (38° C.) and during passage through the tunnel it is cooled to a discharge temperature of +30° F. (−1° C.). As is seen from the food temperature curve of FIG. 2, the temperature of the product decreases progressively from its introduction to its discharge from the freezer. The lower stepped curve in FIG. 2 shows the temperature pattern of nitrogen gas in the tunnel. The lowest temperature is had in supercool zones, 4 and 5 wherein the liquid nitrogen is first introduced and the vapors formed on expansion are recirculated into contact with the product, whereby heat exchange therebetween results in a zone temperature (zones 4 and 5) of −200° F. (==129° C.). From zone 4 there is net positive flow of nitrogen gas towards the products inlet end of the tunnel. As shown on the graph, as the gas flows in order from zone 4 to zone 1 it is progressively warmed in stages by counter-flow heat exchange with product to −100° F. (−73° C.), −30° F. (−34° C.) to a discharge temperature of +20° F. (7° C.). Passing out of zone 1 at the products inlet, the gas enters an exhaust hood, as indicated at 30 (FIG. 1) and is ducted to a remote exhaust fan which discharges the spent nitrogen outside of the building housing the freezer system.

The nitrogen gas leaving zone 5 flows in a direction opposite to that of the gas leaving zone 4. Flowing concurrently with the precooled product leaving zone 5, the nitrogen gas temperature is successively increased in stages by heat exchange with the product as indicated in FIG. 2, to a discharge temperature of −50° F. (−46° C.), at which temperature it enters the exhaust hood 31, from which it is directed to a remote exhaust fan for discharge outside the building.

The indicated temperature in zones 4 and 5 is maintained by a temperature controller, as shown at 23, which actuates a solenoid valve, supplying the coolant fluid to the spray nozzles.

The described freezer design and operation according to the invention, although comparatively simple and uncomplicated, can freeze products economically because it sacrifices only a slight amount of coolant efficiency. When the coolant is injected into the supercold zones (4 and 5), the recirculating gas in these zones is maintained at the controller setpoint. While that portion of the nitrogen gas that flows towards the products discharge end passes through concurrent heat exchange zones of recirculation, which is less efficient than counterflow heat exchange, the loss of coolant efficiency is slight, since only half of the total nitrogen gas is adversely affected, as seen from the following calculation:

$$E_{LIN} = \frac{81.0 + .5\,(0.252)(320 + 20) + .5\,(0.252)(320 - 50)}{81.0 + 0.252\,(320 + 100)}\ 100$$

$$E_{LIN} = 84.5\%$$

In other words, as compared to the prior complicated wholly countercurrent freezer using direct contact of the liquid nitrogen with the product, consumption of LIN is increased by only about 5.5% by the simplified system of the present invention. This modest increase in operating cost is more than offset by the lower capital cost, simplified operation and mechanical reliability of the system of the invention. Moreover, as compared to such prior art system that is poorly operated and not adequately maintained, the coolant consumption by the embodiment of the invention will be 15 to 25% lower.

In the illustrated embodiment of the invention of FIG. 1 the coolant is introduced into four recirculating zones approximate the longitudinal central region of the freezing tunnel. Depending upon the length of the tunnel and the number of individual gas recirculating zones provided, a larger or smaller number of such contiguous zones may be utilized for spraying of the coolant therein, provided that net flow of coolant gas is had in opposite directions from the supercool region of such coolant introduction. Thus, if an odd number of recirculating zones is provided the coolant may be sprayed into a single central zone or an odd number of contiguous zones in the central region of the tunnel. Increased flexibility of operation may be had by providing valve-controlled additional spray jets to be placed in operation at times when additional cooling is required or desired. For example, in the illustrated embodiment using four zones for admission of sprayed coolant, the coolant may be sprayed into zones 4 and 5 only, valves in the lines feeding the spray jets in zones 3 and 6 being maintained shut, subject to being opened at times when so desired in a particular case.

Although liquid nitrogen is the preferred coolant, the invention may be practiced using other known cryogenic refrigerants such as liquid carbon dioxide, liquid air and other refrigerants having normal boiling points substantially below minus 50° F. (−46° C.).

Another important advantage of the present invention is its applicability to the freezing of such food products as baked pastries, ravioli, yeast-rising dough, and similar materials that could be damaged by thermal shock if exposed to direct spray with cryogenic liquids.

While the proportioning of the amount of coolant sprayed into the several cooling zones will depend upon the heat exchange characteristics of the system, as a general rule the central region into which the coolant is sprayed will occupy 15 to 30% of the total freezer length.

In systems wherein coolant is sprayed into more than one zone, it has been found desirable to spray the major portion of the coolant in the region closest to the longitudinal center of the freezing tunnel. Thus in a system having an even number of cooling zones, such as is illustrated in FIG. 1, two-thirds of the total coolant charge may be supplied in equal amounts of zones 4 and 5 and the remainder in equal amounts to zones 3 and 6. In similar manner, in a system having an odd number of cooling zones 40 to 60% of the total coolant charge would be sprayed into the centermost zone and the remainder in equal amounts admitted to the next adjacent zones on each side of such centermost zone.

As above indicated, the freezer temperature is progressively colder from the products entrance to the supercold zone and progressively warmer from the supercold zone to the products outlet. Since the heat transfer rate decreases in the warmer concurrent zones in systems of the invention, the food products will tend to equilibrate, providing a more uniform product temperature that that otherwise obtained.

What is claimed:

1. The method of freezing products by contact with a cryogenic fluid which comprises continuously passing such products through an elongated path comprising a plurality of contiguous vapor recirculating cooling zones, introducing cryogenic liquid refrigerant into one or more of such cooling zones in a substantially central region of such path, wherein such liquid is vaporized by expansion prior to contact with any such products, recirculating the vapor formed by the expansion in the zones of said central region into contact with products passing through said region, inducing a split flow of the vapor from said central region such that one portion thereof flows towards the products inlet end of said path and a second portion flows towards the products discharge end of said path each in direct contact with products moving through the path, and recirculating the vapor individually within each of said plurality of cooling zones.

2. The method is defined in claim 1 wherein the recirculating vapor in a zone is induced to follow an elongated toroidal pattern.

3. The method as defined in claim 1 wherein said plurality of contiguous cooling zones are eight in number and the liquid refrigerant is introduced into the fourth and fifth of said zones.

4. The method as defined in claim 3 wherein said liquid refrigerant is also introduced into the third and sixth of said zones.

5. The method as defined in claim 1 wherein the product is brought to frozen state by progressive and continuous lowering of its temperature as it passes from zone to zone from the inlet to the outlet of the products path.

6. The method as defined in claim 1 wherein the gas temperature is maintained automatically at a preset value in the area approximate the midpoint in the length of said path, said preset value being the lowest temperature in any of the plurality of cooling zones.

7. The method as defined in claim 6 wherein liquid nitrogen is employed as the introduced refrigerant and said preset value is in the range of about −100° to −250° F.

8. The method as defined in claim 6 wherein the vapor temperature in each of the zones between the region of lowest temperature and the products inlet of the path is progressively higher.

9. The method as defined in claim 6 wherein the vapor temperature in each of the zones between the region of lowest temperature and the products discharge end of the path is progressively higher.

10. The method as defined in claim 1 wherein said cryogenic liquid is introduced by spraying the liquid upwardly into the zone in a direction away from products therebelow.

11. The method as defined in claim 1 wherein the recirculating vapor in the zone or zones of liquid refrigerant introduction is induced to follow a toroidal pattern and the refrigerant is sprayed upwardly into said recirculating vapor pattern.

12. A cryogenic freezer for freezing of products, comprising an elongated insulated tunnel, conveyor means for passing of products through said tunnel from inlet to the outlet of said tunnel through a plurality of contiguous heat exchange zones, means for introducing cryogenic liquid refrigerant into at least one of said zones approximate the longitudinal center of said tunnel to effect vaporization of sid liquid by expansion within such zone of liquid introduction, vapor recirculating means within the zone of such liquid introduction for effecting heat exchange contact between the vapor formed by the said expansion and products in such zone, means for inducing split flow of vapor from the zone of liquid introduction with one portion of the vapor flowing in a direction toward the tunnel inlet and a second substantially equal portion flowing toward the tunnel outlet, each vapor flow in contact with products being passed through said tunnel, and means in each of the remaining of said heat exchange zones being provided with individual means for inducing recirculation of vapor within such zone.

13. A cryogenic freezer as defined in claim 12 wherein the vapor recirculating means in said zones of liquid introduction and within said remaining heat exchange zones each comprises a radial fan mounted above said conveyor means.

14. A freezer as defined in claim 13 wherein the fans in adjacent zones are rotated in opposite directions.

15. A cryogenic freezer as defined in claim 12 wherein eight such contiguous heat exchange zones are provided and cryogenic liquid is introduced in the fourth and fifth of such zones.

16. A cryogenic freezer as defined in claim 15 wherein cryogenic liquid is also introduced into the third and sixth of such zones.

17. A cryogenic freezer as defined in claim 12 wherein vapor temperature sensing means are provided in one of the zones of liquid introduction, said sensing means being operatively arranged to maintain a preset vapor temperature in that zone.

18. A cryogenic freezer as defined in claim 16 wherein said sensing means is operatively connected to valve actuating means to control admission of refrigerant to the zone as required to maintain said preset vapor temperature.

19. A cryogenic freezer as defined in claim 12 wherein said means for introducing cryogenic liquid into the zone comprises a spray jet projecting the liquid in an upward direction towards the horizontally whirling blades of a radical fan suspending from the roof of the tunnel.

20. A cryogenic freezer as defined in claim 12 wherein the vapor recirculating means in said zones of cryogenic liquid introduction and in said remaining heat exchange zones each comprises a radial fan provided with a plurality of blades rotated in a horizontal plane, the fans in the zones at the products inlet end of said freezer and at the products discharge end of said freezer being each provided with a bladed stator ring circumferentially surrounding the fan adjacent the terminal edges of the rotating fan blades, the blades of said stator ring being curved with the concave surfaces thereof facing in a direction opposed to that of the rotation of the fan.

21. A cryogenic freezer as defined in claim 12 wherein said plurality of heat exchange zones are separated by vertical partitions extending downwardly from the top of said freezer tunnel to a level above said conveyor means, said partitions confining vapor recirculation within the individual heat exchange zones but permitting unidirectional flow of vapor into the next adjacent zone in a direction toward the nearest tunnel end.

* * * * *

UNITED STATES PATENT AND TRADEMARK OFFICE

CERTIFICATE OF CORRECTION

PATENT NO. : 4,475,351

DATED : October 9, 1984

INVENTOR(S) : David Jean Klee

It is certified that error appears in the above-identified patent and that said Letters Patent are hereby corrected as shown below:

Column 8, Line 1
Delete "sid" and substitute therefor--said--

Column 8, Line 43
Delete "radical" and substitute therefor--radial--

Signed and Sealed this

*Thirtieth* Day of *July 1985*

[SEAL]

*Attest:*

DONALD J. QUIGG

*Attesting Officer* *Acting Commissioner of Patents and Trademarks*